United States Patent [19]

Gaskell

[11] Patent Number: 5,033,186

[45] Date of Patent: Jul. 23, 1991

[54] APPARATUS FOR ASSEMBLING TERMINATED WIRES INTO CONNECTORS TO FORM ELECTRICAL HARNESSES

[75] Inventor: Clive Gaskell, Fleet, England

[73] Assignee: Molex Incorporated, Lisle, Ill.

[21] Appl. No.: 537,736

[22] Filed: Jun. 14, 1990

[51] Int. Cl.[5] ..... H01R 43/04

[52] U.S. Cl. ..... 29/749; 29/753; 29/759

[58] Field of Search ..... 29/748, 749, 751, 742, 29/753, 759, 564.4, 564.8

[56] References Cited

U.S. PATENT DOCUMENTS 4,493,147 1/1985 Bakermans ..... 29/748 X 4,835,844 6/1989 Gevst et al. ..... 29/759 X 4,936,011 6/1990 Berry et al. ..... 29/748 X

*Primary Examiner*—Carl E. Hall

*Attorney, Agent, or Firm*—Louis A. Hecht; Stephen Z. Weiss; Charles S. Cohen

[57] ABSTRACT

Apparatus for changing the order of wires in an array of wires being assembled into an electrical harness consisting of an auxiliary gripper 250 for individually gripping the ends of wires projecting from a guide 203A and a crossover gripper 252 for withdrawing a wire from the auxiliary gripper and the guide and locating it in a different wire position in the auxiliary gripper and guide. To allow for changing over wire a second crossover gripper 256 is provided each crossover gripper preferably having an associated tip gripper 254, 258 to guard against wire curl.

14 Claims, 4 Drawing Sheets

APPARATUS FOR ASSEMBLING TERMINATED WIRES INTO CONNECTORS TO FORM ELECTRICAL HARNESSES

FIELD OF THE INVENTION

The present invention relates to apparatus for assembling terminated wires into electrical connectors to form harnesses and in particular to such apparatus which can form harnesses in which the order of wires is not the same at each end.

In order to conduct electrical signals between printed circuit board assemblies or components by means of electrical conductors in electrically operated equipment and products, it is common to employ a harness of terminated wires assembled into a single connector at at least one end, the wires being also terminated at their other ends.

SUMMARY OF THE INVENTION

The object of the present invention is to provide an improved apparatus for the semi-automatic or automatic manufacture of such harnesses.

The present invention is apparatus for changing the order of wires in an array of wires, the apparatus comprising a first guide for clamping the array adjacent one end while leaving the ends of the wires projecting from the guide, a second guide for clamping the array adjacent its other end, an auxiliary gripper for individually clamping each projecting wire end, a crossover gripper for gripping a wire adjacent the first guide and between the two guides and means for moving the crossover gripper in a first direction axially of the wires, in a second direction transversely of the wires and in a third direction perpendicular to the first and second directions.

BRIEF DESCRIPTION OF THE DRAWINGS

Embodiments of the present invention will now be described by way of example, with reference to the accompanying drawings in which.

DESCRIPTION OF THE PREFERRED EMBODIMENT

Figure 1:
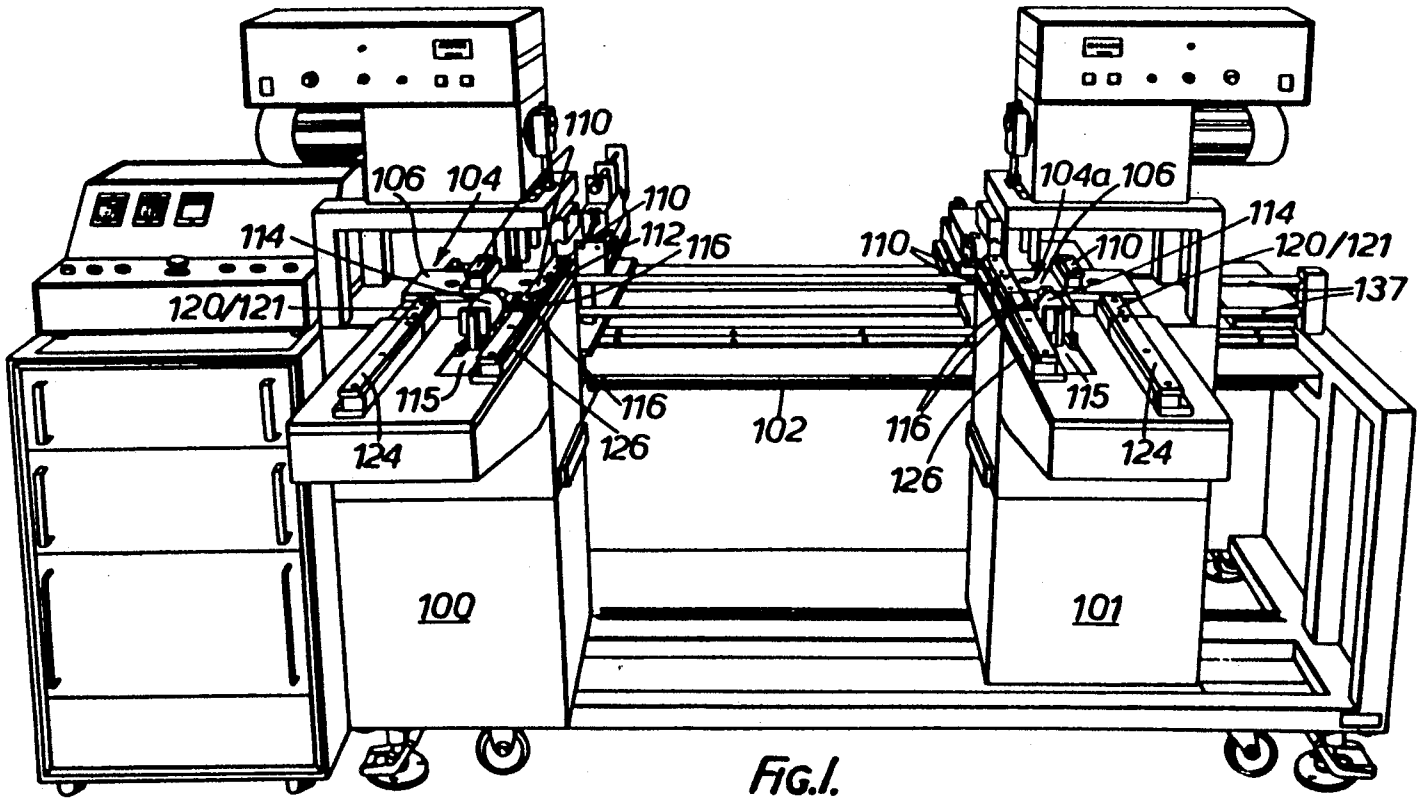
FIG. 1 shows a harness assembling apparatus.
Figure 2:
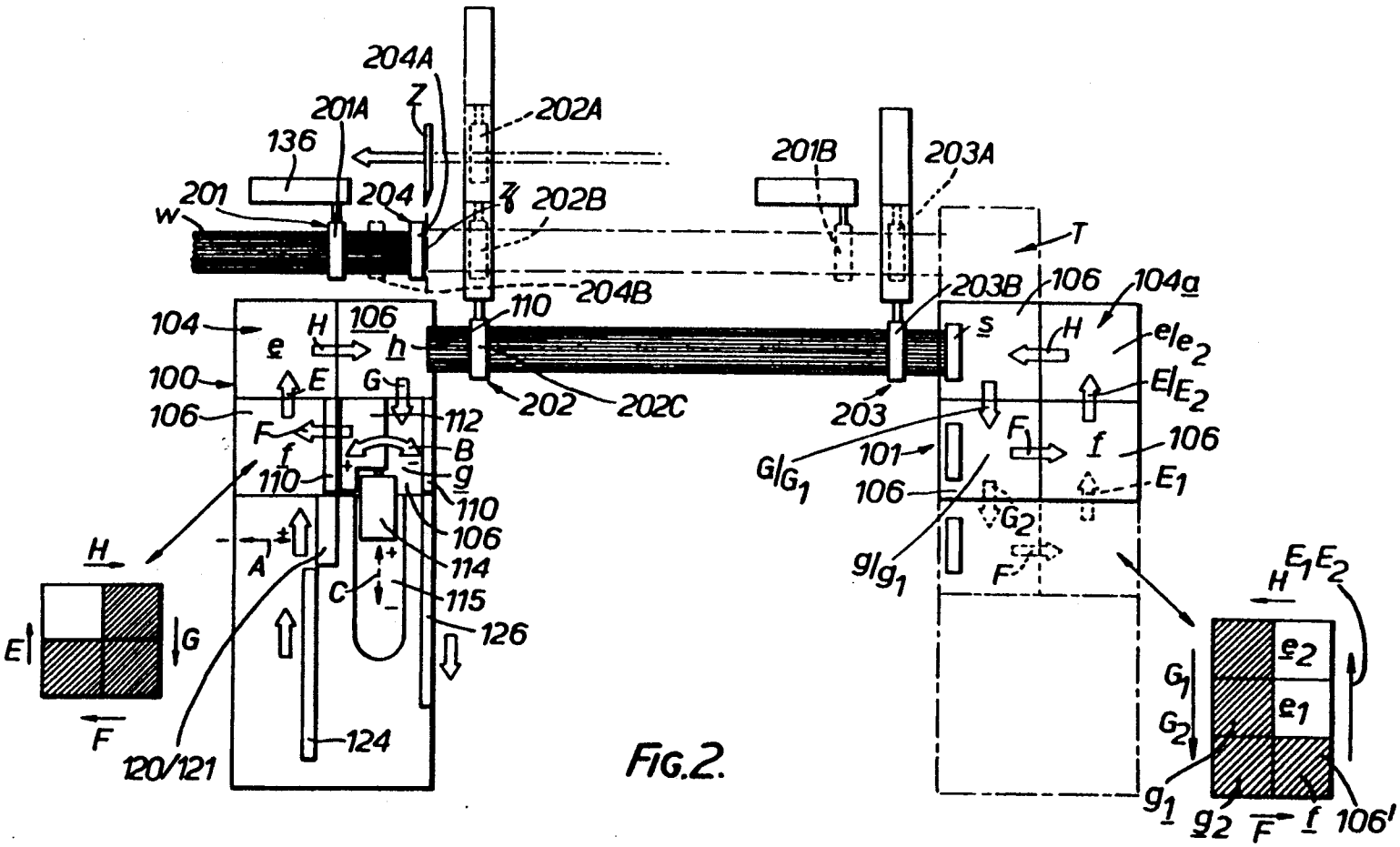
FIGS. 2 and 3 are diagrams illustrating the operation of the apparatus of FIG. 1.
Figure 3:
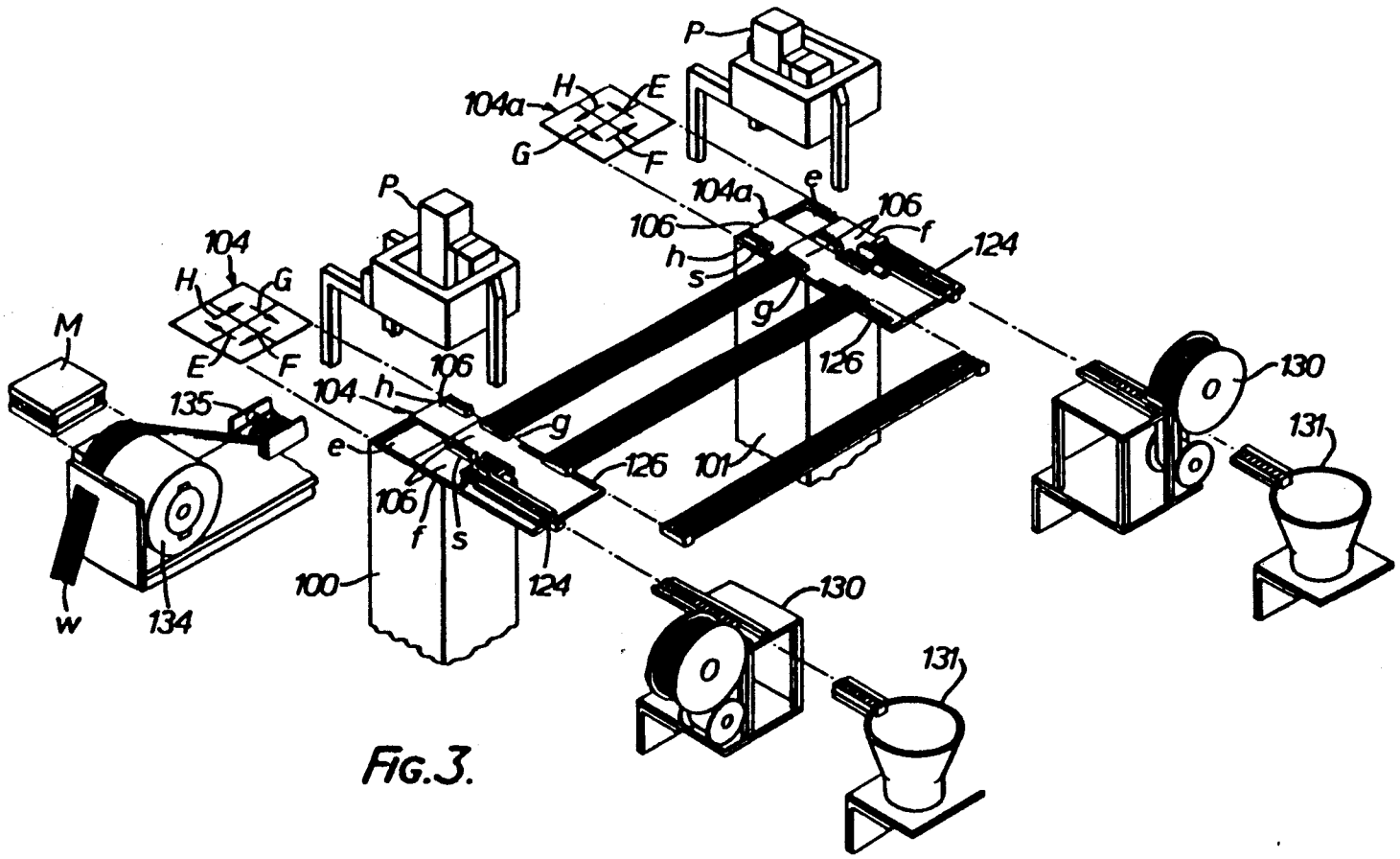

With reference now to FIGS. 1 to 4 of the accompanying drawings, apparatus according to the present invention comprises left and right hand shuttle table towers, generally indicated at 100 and 101 respectively spaced apart and relatively movable towards and away from one another by means of a lead screw 102 to select the length of the harnesses to be assembled. Each tower is topped by a shuttle table system 104, 104*a* made up of three, square, shuttle tables 106 which are movable in turn, and in a following sequence, one with respect to another, as indicated by the arrows G F E H in FIG. 2, that is to say, into successive ones of four positions around a closed, rectilinear, square form path. The respective shuttle table systems 104, 104*a* operate in opposite directions of movement, the tables of the left hand system 104 as seen in FIGS. 1 to 3 moving clockwise, and the tables of the right hand system as seen in FIGS. 1 to 3 moving counter clockwise. Each table moves only in a linear direction; the tables moving in the directions indicated by the arrows G F E H. Each table 106 carries an elongated, slotted track-like fixture 110 having a track for positioning individual connectors or a stick or sticks of interconnected connectors s. The fixtures 110 are carried by the tables with their tracks parallel with one another. The fixtures 110 of the left hand shuttle table system 104 are positioned along the right hand edge of each table 106 and fixtures 110 of the right hand shuttle table system 104*a* are positioned along the left hand edge of each table 106.

The shuttle table systems 104, 104*a* have their table fixtures 110 moved successively, in the directions indicated by arrows F into connector loading stations f, e.g. in which sticks of connectors are loaded into the fixture tracks, then in the directions indicated by arrows E into void positions e, then in the directions indicated by arrows H into termination stations h, in which wires w are terminated into sticks of connectors, then in the directions indicated by arrows G into test and eject stations g in which the assembled harnesses are tested and then unloaded from the fixture tracks onto an eject track.

Associated with each shuttle table system 104, 104*a* is a linearly movable feed/location member in the form of a plate 112 carried by a rotating actuator 114 mounted on a pneumatically operated slide 115 to slide to-and-fro in the directions of arrows E and G and as indicated by the double-headed arrow C in FIG. 2. The actuator 114 is actuable to position the plate 112 alternately over the loading station f and the eject station g, as indicated by the double-headed arrow B. The plate 112 has a row of location teeth 116 on each side to locate in the wire receiving recesses (not shown) in connector sticks s held in the tracks of fixtures 110 positioned at the loading and eject stations f and g respectively. The rows of teeth 116 are predeterminedly spaced to engage one tooth in each of the connector stick recesses, there being a recess formed at each circuit point of each connector stick. The teeth 116, therefore, engage with the connector sticks s to entrain the connector sticks for loading and, thereafter, unloading movements along the fixture tracks as the actuator 114 is slid to-and-fro in the directions C+ and C− respectively, the actuator having previously been actuated to rotate the plate 112 in the directions B+ and B− respectively.

Also associated with each shuttle table system 104, 104*a* is a pre-position shuttle and component load actuator 120 which carries a track block having a track 121 for guiding sticks of connectors s parallel with the tracks of the fixtures 110 mounted on the shuttle tables. Each actuator 120 is mounted on a pneumatically operated slide so as to be slidable to-and-fro in the directions of arrows H and F as indicated by the double headed arrow A in the direction A+ to align its connector stick track respectively with that of a fixture 110 in the loading station f and in the direction A- to align its connector stick track with a connector stick loading track 124 parallel to, but outwardly offset, with respect to the fixtures 110 positioned at the loading stations f. Eject tracks 126 are provided for the connectors s of the assembled harnesses, these aligning with the tracks of the fixtures 110 positioned at the test and eject stations g. Connectors or connector sticks s may be loaded into the loading tracks by means of a bowl feed, a tape reel feed, or by hand. By way of example, both tape feed and bowl feed mechanisms are indicated respectively at 130 and 131 in FIG. 3.

Wire feed may be from reels of discrete wires w, or ribbon cable may be used. Discrete wires w are fed in over a changeover drum 134 (see FIG. 3), for measuring the wires, the drum being selected according to the size of the wires w, and then through a wire straightener 135. The wires are fed in transversely of the loading and eject tracks 124, 126 behind the shuttle table towers 100, 101 and are mechanically handled by wire guides 201, 202, 203 and 204 indicated diagrammatically in FIG. 2. The carriage wire guide 201 is carried for transverse movements, between a fixed position 201A and a selectable position 201B, by a carriage 136 movable to-and-fro on track rods 137 (see FIG. 1), and this guide moves between the jaws of the wire cutting station guide 204 when the wire guide 204 is open. The position 201B of the carriage wire guide is selected depending upon the spacing of the right hand tower 101 from the left hand tower 100 and the positions 201A and 201B remain in the same position as shown in FIG. 2, relative to the towers 100, 101 respectively. The wire guide 204 is movable between two positions fixed relative to the tower 100, as shown in FIG. 2, and in position 204A it aligns with each fixture 110 positioned at the termination station h and with the wire cutting station z. The left and right hand wire guides 202 and 203 associated with the left and right hand towers 100, 101 respectively, are movable to-and-fro in the lengthwise direction of the loading and unloading tracks 124, 126. The guide 202 has a rearmost position 202A out of the path of movement of the carriage 136, a second wire gripping position 202B on which it aligns transversely with the wire guides 201 and 204 on the inboard side of the positions 201A, 204B and 204A and a third or forward-most position 202C in which it aligns with the wire termination station h of the left hand shuttle table system 100 on the inboard side. The guide 203 has two positions 203A and 203B which it always maintains relative to the tower 101, corresponding to the positions 202B and 202C respectively, and the guides 202 and 203 move between their positions 202B, 203A and 202C, 203B in unison.

In the initial setting of the apparatus, the wires w are fed through the wire guide 201 positioned at 201A and are overfed through wire guide 204 with the guide 204 in the position 204A, that is to say, in its position to grip the wires during the wire cutting by the wire cutter Z. The guide 204 is not closed at this stage. Also, the left and right hand guides 202 and 203 are open and positioned at 202A and 203A respectively. The guide 201A is closed to grip the wires and the wire cutter Z is operated to cut the wires w, thereby to align the ends of the wires at the wire cutting station z. In operation of the apparatus, the wire guides are automatically sequenced as follows: Guide 201 moves from 201A to 201B to transport the cut wire ends to align with the right hand termination station h. The wires are overfed through the guide 203 which then closes to grip the wires. Guide 201 then opens and moves back to 201A and recloses. At this stage, the wire ends, gripped by the guide 203, may be operated upon by a single ended wire insulation stripper unit T. In the present example, however, it is assumed that an I.D.T. connector is being used at each end. Next, the wire guide 202 moves to 202B and closes, gripping the wires adjacent the left hand tower 100. Next, the wire guide 204A closes and required lengths of harness wires w are cut off from the feed wires at the station z. Next, the wire guide 201 opens and the wire guide 204 moves to 204B retracting the feed wire ends. Next, the wire guides 202 and 203 move in unison to 202C and 203B respectively to position the harness wire ends at the wire insertion stations h. Termination presses P carried one over each of the shuttle table towers are then operated to terminate the wires in connector sticks s positioned at the termination stations h. Next, the wire guides 202 and 203 open and move to positions 202A and 203A respectively. Next, the wire guide 204 moves to 204A. Next, the carriage wire guide 201 closes on the feed wires w at the input feed. At the same time the wire guide 204 opens to allow the passage of the carriage wire guide to the position 201B as the automatic wire feed cycle re-commences.

The apparatus described above is very efficient in producing harnesses in which the wires are in the same order at each end of the harness. It is however not always possible to design the printed circuit board assemblies or components to be connected to the harness such that the same order is maintained. The apparatus illustrated in FIG. 4 is provided to enable crossovers to be provided as necessary.

Figure 4:
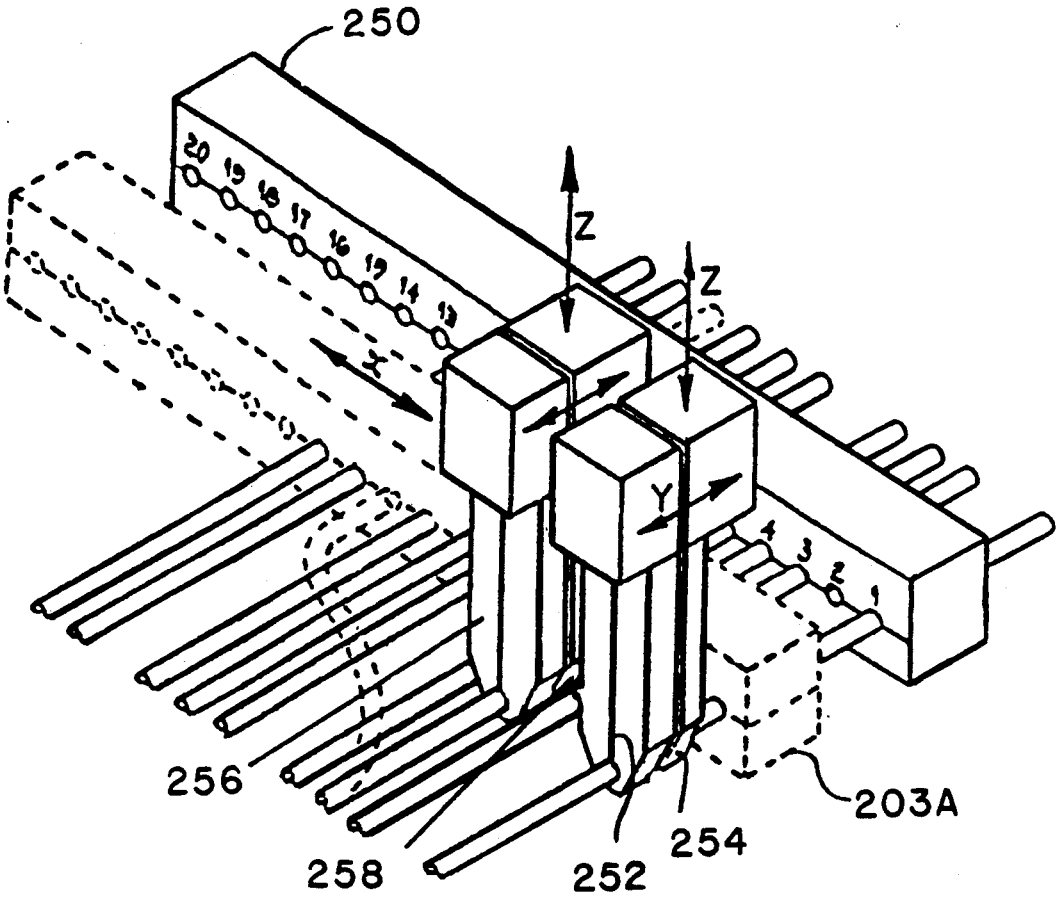
FIG. 4 is a diagram illustrating crossover apparatus according to the present invention.

As shown in FIG. 4 the crossover apparatus comprises an auxiliary gripper 250, two crossover grippers 252 and 256, each having a respective wire tip gripper 254 or 258 associated therewith.

The apparatus of FIG. 4 is used in conjunction with the guide 203 when it and the guide 202 are respectively in the position 203A and 202B holding between them an array of wires cut to length. The auxiliary gripper 250 is mounted to be movable from the right to a position almost abutting the guide 203 and there engage the ends of the wires projecting beyond the guide 203. The gripper 250 consists of individually operable pairs of jaws for each wire; each pair of jaws has two positions—an open position in which it may be moved relative to the wires and a closed position in which it grips and secures the ends of the wires.

The crossover grippers 252 and 256 together with their tip grippers 254 and 258 are mounted to be movable transversely of the wires in the direction 'x' of FIG. 4 from an inoperative or parked position at the rear of the apparatus of FIG. 4, in which they are clear of the movements of the guides 201 and 203, to an operative position generally as shown in FIG. 4. The spacing of the crossover grippers in the 'x' direction is fixed and the crossover grippers are independently movable, but each with its associated tip gripper vertically in the 'z' direction. Moreover, the crossover grippers can each move independently relative to its associated tip gripper in the 'y' direction, i.e. axially of the wires.

The jaws of the guide 203 is provided with three operating positions—an open position in which the jaws of the guide are clear of the wires, a guide position in which the jaws allow axial movement of the wires while preventing transverse or lateral movements, and a closed position in which the jaws grip the wires.

The use of the crossover apparatus will now be illustrated by the transfer of a wire end from position number 4 in the guide 203 to position number 10 as shown in dotted lines in FIG. 4. The wires are secured by the guide 203 and the auxiliary clamp 250 is in position abutting the guide 203 with its jaws closed to grip the wires. The jaws of guide 203 are then put in the guide position. The crossover grippers 252 and 256 with the associated tip grippers 254 and 258 are then moved across above the wires from their parked position until the grippers 256 and 258 are above the wire in position 4. The grippers 256 and 258 are then lowered and the gripper 256 is closed on the wire to grip it. The appropriate jaws of the auxiliary gripper 250 are opened to release the wire and the gripper 256 is moved away from the gripper 258 in the Y direction until the lip of the wire is clear of the guide 203, at which point the gripper 258 is closed to grip the wire. The grippers 256 and 258 are then raised, indexed to position number 10 and lowered. The tip gripper 258 is then opened, the crossover gripper 256 moved to the right (as viewed in FIG. 4) towards the tip gripper to pass the wire tip through the guide 203 to the auxiliary gripper which can then grip the tip of the wire allowing the grippers 256 and 258 to be withdrawn. If the transfer of the wire from position 4 to position 10 is the only transfer required then the guide 203 can be closed and the auxiliary clamp 250 opened and then withdrawn.

If for example two wires are to be interchanged then both of the gripper clamps 252 and 256 are utilized. The procedure is similar to that described above, one clamp picking up one wire, the other clamp picking up the second wire, the one clamp relocating the first wire in the space vacated by the second wire and the other clamp relocating the second wire in the space vacated by the first wire.

It should be noted that the above interchange can be achieved by a single crossover clamp, together with its associated tip clamp if there is an unused wire space in the guide 203 which can be used to locate the first wire while the second wire is being relocated, the first wire subsequently being retrieved and relocated.

More complicated crossovers can also be achieved by the basic technique of holding a wire in one crossover gripper while retrieving and relocating a second wire using the second crossover gripper.

Each crossover gripper is provided with an associated tip gripper because otherwise there is a danger that the wire tip might curl out of alignment with the passage in the guide 203 because the memory of the wire is not entirely destroyed by the wire straightening techniques previously described. If however this wire curl is not a problem then the wire tip grippers 254 and 258 could be dispensed with.

Because a wire that has been relocated inevitably follows a longer path between the guides 202 and 203 the tip of the relocated wire may not project sufficiently beyond the guide 203. This problem may be overcome by introducing slack into the wires before commencing the crossover process. This slack may be introduced by, for example, forming a loop in the wires by a conventional looper system or by making the initial spacing between the guides 202 and 203 greater than desired and then reducing the spacing to the desired value before commencing crossover.

I claim:

1. An apparatus for changing the order of wire in an array of wires and providing terminals on the wires, the apparatus comprising:

a first guide means for clamping the array adjacent one end while leaving unterminated ends of the wires projecting from the guide;

a second guide means for maintaining the position of the array adjacent its other end;

an auxiliary gripper means adjacent said first guide means for independently clamping each projecting wire end;

a crossover gripper means for gripping a wire of said array adjacent the first guide means and between the two guide means;

means for moving the crossover gripper means in a first direction, axially of the wires, in a second direction transversely of the wires and in a third direction perpendicular to the first and second directions; and means for simultaneously terminating said ends of said wires to terminals contained within an insulative housing.

2. An apparatus as in claim 1, further comprising a tip gripper means associated with the crossover gripper means for gripping a wire between the crossover gripper means and the first guide means, and means for moving the tip gripper means with the crossover gripper means in the second and third directions, the tip gripper means being fixed against movement in the first direction.

3. An apparatus as in claim 2 further comprising a second crossover gripper means spaced from said first gripper crossover means in the third direction for gripping a second wire of said array adjacent the first guide means and between the two guide means; and means for moving the second crossover gripper means in said first, second and third directions.

4. An apparatus as in claim 3, further comprising a second tip gripper means associated with the second crossover gripper means for gripping said second wire between the second crossover gripper means and the first guide means, and means for moving the second tip gripper means with the second crossover gripper means in the second and third direction, the second tip gripper means being fixed against movement in the first direction.

5. An apparatus as in claim 1 further comprising a second crossover gripper means spaced from said first gripper crossover means in the third direction for gripping a second wire of said array adjacent the first guide means and between the two guide means; and means for moving the second crossover gripper means in said first, second and third directions.

6. An apparatus as in claim 1 wherein said first guide means is moveable between a first clamped position, a second unclamped position and a third guide position between said first and second positions, wherein said first guide means maintains the axial spacing of said wires adjacent said one end when in said third position yet permits movement of said wires in said first direction.

7. An apparatus as in claim 5 wherein said first guide means is moveable between a first clamped position, a second unclamped position and a third guide position between said first and second positions wherein said first guide means maintains the axial spacing of said wires adjacent said one end when in said third position yet permits movement of said wires in said first direction.

8. An apparatus for changing the order of wires in a generally planar array of wires and terminating the wires, the apparatus comprising:

means for feeding a plurality of wires to create a generally planar array of wires, each having a first end without terminals mounted thereon, and in which none of the wires cross over another;

a guide means for supporting the array adjacent said first end;

a crossover gripper means for gripping a wire of said array adjacent the guide means with said guide means located between said crossover gripper means and said first end of said wire;

means for moving the crossover gripper means in a first direction, axially of the wires, in a second direction transversely of the wires and in a third direction perpendicular to the first and second directions; and means for simultaneously inserting the first ends of said wires into terminals in an insulative housing.

9. The apparatus as in claim 8 further comprising an auxiliary gripper means adjacent said guide means for selectively clamping any of said first ends of said wires.

10. An apparatus as in claim 8, further comprising a tip gripper means associated with the crossover gripper means for gripping a wire between the crossover gripper means and the guide means, and means for moving the tip gripper means with the crossover gripper means in the second and third directions, the tip gripper means being fixed against movement in the first direction.

11. An apparatus as in claim 10, further comprising a second crossover gripper means spaced from said first gripper crossover means in the third direction for gripping a second wire of said array adjacent the guide means, and means for moving the second crossover gripper means in said first, second and third directions.

12. An apparatus as in claim 11, further comprising a second tip gripper means associated with the second crossover gripper means for gripping a wire between the second crossover gripper means and the guide means, and means for moving the second tip gripper means with the second crossover gripper means in the second and third directions, the second tip gripper means being fixed against movement in the first direction.

13. An apparatus as in claim 12 wherein said guide means is moveable between a first clamped position, a second unclamped position and a third guide position between said first and second positions, wherein said first guide means maintains the axial spacing of said wires adjacent said first end when in said third position yet permits movement of said wires in said first direction.

14. An apparatus as in claim 9, further comprising a tip gripper means associated with the crossover gripper means for gripping a wire between the crossover gripper means and the guide means, and means for moving the tip gripper means with the crossover gripper means in the second and third directions, the tip gripper means being fixed against movement in the first direction.

* * * * *